US010971878B2

(12) United States Patent
Suzuki et al.

(10) Patent No.: US 10,971,878 B2
(45) Date of Patent: Apr. 6, 2021

(54) METHOD FOR MANUFACTURING TERMINAL-EQUIPPED ELECTRICAL WIRE, TERMINAL-EQUIPPED ELECTRICAL WIRE, AND ULTRASONIC WELDING DEVICE

(71) Applicant: SUMITOMO WIRING SYSTEMS, LTD., Mie (JP)

(72) Inventors: Takuya Suzuki, Mie (JP); Tatsuo Tamagawa, Mie (JP); Daichi Miura, Mie (JP); Yo Nakamura, Mie (JP)

(73) Assignee: SUMITOMO WIRING SYSTEMS, LTD., Mie (JP)

( * ) Notice: Subject to any disclaimer, the term of this patent is extended or adjusted under 35 U.S.C. 154(b) by 0 days.

(21) Appl. No.: 16/637,980

(22) PCT Filed: Aug. 16, 2018

(86) PCT No.: PCT/JP2018/030430
§ 371 (c)(1),
(2) Date: Feb. 10, 2020

(87) PCT Pub. No.: WO2019/039379
PCT Pub. Date: Feb. 28, 2019

(65) Prior Publication Data

US 2020/0169052 A1 May 28, 2020

(30) Foreign Application Priority Data

Aug. 25, 2017 (JP) ..... JP2017-162494

(51) Int. Cl.
*H01R 43/048* (2006.01)
*H01R 43/02* (2006.01)
(Continued)

(52) U.S. Cl.
CPC ..... *H01R 43/0207* (2013.01); *H01R 4/029* (2013.01); *H01R 43/0482* (2013.01);
(Continued)

(58) Field of Classification Search
CPC ..... H01R 4/187; H01R 4/029; H01R 4/185; H01R 43/048; H01R 43/0482; H01R 43/0207
See application file for complete search history.

(56) References Cited

U.S. PATENT DOCUMENTS 6,742,251 B1 * 6/2004 Fukase ..... H01R 43/048 29/450
8,870,611 B2 * 10/2014 Sato ..... H01R 4/188 439/877
(Continued)

FOREIGN PATENT DOCUMENTS

JP 2003-217784 7/2003
JP 2006-092992 4/2006
(Continued)

OTHER PUBLICATIONS

Official Communication issued in International Bureau of WIPO Patent Application No. PCT/JP2018/030430, dated Nov. 6, 2018.

*Primary Examiner* — Tho D Ta
(74) *Attorney, Agent, or Firm* — Greenblum & Bernstein, P.L.C.

(57) ABSTRACT

A method for manufacturing a terminal-equipped electric wire is a method in which an exposed core wire of the electric wire is ultrasonically welded to a core wire connection portion of a terminal having a core wire connection portion and a coating crimping portion. The manufacturing method for the terminal-equipped electric wire including: supporting the core wire connection portion on an anvil; bringing the coating crimping portion into contact with a vibration suppressing contact portion; arranging the exposed core wire on the core wire connection portion and arranging the coating of the electric wire in the coating crimping portion; and ultrasonically welding the exposed core wire to the core wire connection portion in a state where the core
(Continued)

wire connection portion is supported on the anvil and the coating crimping portion is in contact with the vibration suppressing contact portion.

8 Claims, 9 Drawing Sheets

(51) Int. Cl.
*H01R 4/02* (2006.01)
*H01R 4/18* (2006.01)

(52) U.S. Cl.
CPC ..... *H01R 4/185* (2013.01); *H01R 4/187* (2013.01); *H01R 43/048* (2013.01)

(56) References Cited

U.S. PATENT DOCUMENTS

| | | | | |
|---|---|---|---|---|
| 9,570,870 | B2 * | 2/2017 | Kawamura ..... | H01R 43/048 |
| 2006/0068653 | A1 | 3/2006 | Sakaguchi et al. | |
| 2019/0052040 | A1 * | 2/2019 | Suzuki ..... | H01R 43/02 |

FOREIGN PATENT DOCUMENTS

| | | |
|---|---|---|
| JP | 2006-107882 | 4/2006 |
| JP | 2006-114343 | 4/2006 |
| JP | 2014-143177 | 8/2014 |

* cited by examiner

METHOD FOR MANUFACTURING TERMINAL-EQUIPPED ELECTRICAL WIRE, TERMINAL-EQUIPPED ELECTRICAL WIRE, AND ULTRASONIC WELDING DEVICE

TECHNICAL FIELD

The present invention relates to a technique for ultrasonically welding a core wire of an electric wire to a terminal.

BACKGROUND ART

Patent Document 1 discloses a technique for ultrasonically welding an electric wire connection portion of a terminal and a core wire of an electric wire, with the electric wire connection portion and the core wire sandwiched between an anvil and an ultrasonic horn. Patent Document 1 also discloses a technique with which the core wire of an electric wire is ultrasonically welded to a bottom plate of a core wire connection portion in a case where the electric wire connection portion of the terminal includes a core wire connection portion and a coating crimping portion.

CITATION LIST

Patent Documents

Patent Document: 1 JP 2014-143177A

SUMMARY OF INVENTION

Technical Problem

However, it has been found that, when the core wire of the electric wire is ultrasonically welded to the core wire connection portion of the terminal as described above, cracks may occur at the base end of the coating crimping portion.

In view of this, an object of the present invention is to make it possible to ultrasonically weld a core wire of an electric wire to a core wire connection portion of a terminal while suppressing cracks at a base end of a coating crimping portion of the terminal.

Solution to Problem

In order to solve the above-described problem, a first aspect is a method for manufacturing a terminal-equipped electric wire by ultrasonically welding a core wire of an electric wire to a core wire connection portion of a terminal that includes the core wire connection portion and a coating crimping portion, the method including: (a) a step of supporting the core wire connection portion on an anvil; (b) a step of bringing the coating crimping portion into contact with a vibration suppressing contact portion; (c) a step of arranging the core wire on the core wire connection portion and arranging a coating of the electric wire in the coating crimping portion; and (d) a step of ultrasonically welding the core wire to the core wire connection portion in a state where the core wire connection portion is supported on the anvil and the coating crimping portion is in contact with the vibration suppressing contact portion, and the coating crimping portion is supported on the vibration suppressing contact portion in a state where the coating crimping portion is in contact with the vibration suppressing contact portion at a position spaced apart from the anvil in a direction toward a rear end of the coating crimping portion, and in step (d), a region in which the terminal is not in contact with the anvil and the vibration suppressing contact portion is present between the portion in which the anvil and the core wire connection portion are in contact with each other and a region in which the vibration suppressing contact portion and the coat crimping portion are in contact with each other.

A second aspect is the method for manufacturing the terminal-equipped electric wire according to the first aspect, wherein the vibration suppressing contact portion supports the coating crimping portion from the same side as the anvil.

A fourth aspect is the method for manufacturing the terminal-equipped electric wire according to the second aspect, further including (e) a step of crimping the coating crimping portion on the coating using the vibration suppressing contact portion as a crimping anvil in a state where the coating crimping portion is supported on the vibration suppressing contact portion.

In order to solve the above-described problem, a fifth aspect is a terminal-equipped electric wire including: an electric wire that includes a core wire and a coating that covers a periphery of the core wire, a portion of the core wire being an exposed core wire that is exposed from the coating; and a terminal that includes a core wire connection portion that is ultrasonically welded to the exposed core wire, and a coating crimping portion that is crimped on the coating, a non-through contact mark that is partially recessed being formed on a surface of the coating crimping portion that faces outward in a direction wherein the exposed core wire and the core wire connection portion are welded to each other.

A sixth aspect is the terminal-equipped electric wire according to the fifth aspect, wherein the contact mark is formed at a position of the coating crimping portion that is spaced apart from the core wire connection portion in a direction toward the rear end of the coating crimping portion.

In order to solve the above-described problem, a seventh aspect is an ultrasonic welding device that ultrasonically welds a core wire of an electric wire to a core wire connection portion of a terminal that includes a core wire connection portion and a coating crimping portion, the ultrasonic welding device including: an anvil that supports the core wire connection portion; an ultrasonic vibration imparting mechanism that, in a state where the core wire is placed on the core wire connection portion that is supported on the anvil, applies a force that presses the core wire against the core wire connection portion, and imparts ultrasonic vibration to the core wire and the core wire connection portion to ultrasonically weld the core wire and the core wire connection portion; and a vibration suppressing contact portion that comes in contact with the coating crimping portion during ultrasonic welding performed by the ultrasonic vibration imparting mechanism, and the vibration suppressing contact portion comes in contact with the coating crimping portion at a position spaced apart from the anvil in a direction toward the rear end of the coating crimping portion, and a region in which the terminal is not in contact with the anvil and the vibration suppressing contact portion is present between the portion in which the anvil and the core wire connection portion are in contact with each other and a region in which the vibration suppressing contact portion and the coat crimping portion are in contact with each other.

A eighth aspect is the ultrasonic welding device according to the seventh aspect, wherein the vibration suppressing contact portion supports the coating crimping portion from the same side as the anvil.

A tenth aspect is the ultrasonic welding device according to the eighth aspect, further including a crimper that crimps the coating crimping portion on the coating of the electric wire using the vibration suppressing contact portion as a crimping anvil in a state where the coating crimping portion is supported by the vibration suppressing contact portion.

Advantageous Effects of Invention

According to the first aspect, since the core wire is ultrasonically welded to the core wire connection portion in a state where the core wire connection portion is supported on the anvil and the coating crimping portion is in contact with the vibration suppressing contact portion, vibration of the coating crimping portion can be suppressed even if vibration due to the ultrasonic welding is transferred to the coating crimping portion. Accordingly, it is possible to ultrasonically weld the core wire of the electric wire to the core wire connection portion of the terminal while suppressing cracks at a base end of the coating crimping portion of the terminal.

According to the second aspect, the coating crimping portion of the terminal is pressed against the vibration suppressing contact portion during ultrasonically welding. In this manner, vibration of the coating crimping portion can be effectively suppressed.

When attempting to strongly press the coating crimping portion against the vibration suppressing contact portion during ultrasonic welding, the coating crimping portion is likely to be inclined toward the core wire connection portion. In view of this, as in the first aspect, if the coating crimping portion is supported on the vibration suppressing contact portion in a state where the coating crimping portion is in contact with the vibration suppressing contact portion at a position spaced apart from the anvil toward the rear end of the coating crimping portion, the coating crimping portion is not likely to be inclined toward the core wire connection portion when the coating crimping portion is strongly pressed against the vibration suppressing contact portion during ultrasonic welding.

According to the fourth aspect, the coating crimping portion can be crimped on the coating using the vibration suppressing contact portion as the crimping anvil.

According to the fifth aspect, a contact mark is left at a position of the surface of the coating crimping portion that faces outward in the direction in which the exposed core wire is welded to the core wire connection portion, the position having been supported by another member during ultrasonic welding, on the surface of the coating crimping portion which faces outward in the direction in which such welding is performed. Accordingly, this terminal-equipped electric wire is manufactured by ultrasonically welding the core wire of the electric wire to the core wire connection portion of the terminal while suppressing cracks at the base end of the coating crimping portion of the terminal.

When attempting to strongly press the coating crimping portion against another member during ultrasonic welding, the coating crimping portion is likely to be inclined toward the core wire connection portion. In view of this, if the other member supports the coating crimping portion at a position of the coating crimping portion that is spaced apart from the core wire connection portion in the direction toward the rear end of the coating crimping portion, and as in the sixth aspect, the contact mark is formed at the position of the coating crimping portion that is spaced apart from the core wire connection portion in the direction toward the rear end of the coating crimping portion, the coating crimping portion is not likely to be inclined toward the core wire connection portion when the coating crimping portion is strongly pressed against the vibration suppressing contact portion during ultrasonic welding.

According to the seventh aspect, since the core wire can be ultrasonically welded to the core wire connection portion in a state where the core wire connection portion is supported on the anvil and the coating crimping portion is in contact with the vibration suppressing contact portion, vibration of the coating crimping portion can be suppressed even if vibration due to the ultrasonic welding is transferred to the coating crimping portion. Accordingly, it is possible to ultrasonically weld the core wire of an electric wire to the core wire connection portion of the terminal while suppressing cracks at the base end of the coating crimping portion of the terminal.

According to the eighth aspect, the coating crimping portion of the terminal is pressed against the vibration suppressing contact portion during ultrasonic welding. In this manner, vibration of the coating crimping portion can be effectively suppressed.

According to the seventh aspect, when attempting to strongly press the coating crimping portion against the vibration suppressing contact portion during ultrasonic welding, the coating crimping portion is likely to be inclined toward the core wire connection portion. In view of this, as in the eighth aspect, if the vibration suppressing contact portion is in contact with the coating crimping portion at a position spaced apart from the anvil in a direction toward the rear end of the coating crimping portion, the coating crimping portion is not likely to be inclined toward the core wire connection portion when the coating crimping portion is strongly pressed against the vibration suppressing contact portion during ultrasonic welding.

According to the tenth aspect, the coating crimping portion can be crimped on the coating using the vibration suppressing contact portion as the crimping anvil.

DESCRIPTION OF EMBODIMENTS

Hereinafter, a method for manufacturing a terminal-equipped electric wire, a terminal-equipped electric wire, and an ultrasonic welding device according to embodiments will be illustrated.

Terminal-Equipped Electric Wire

Figure 1:
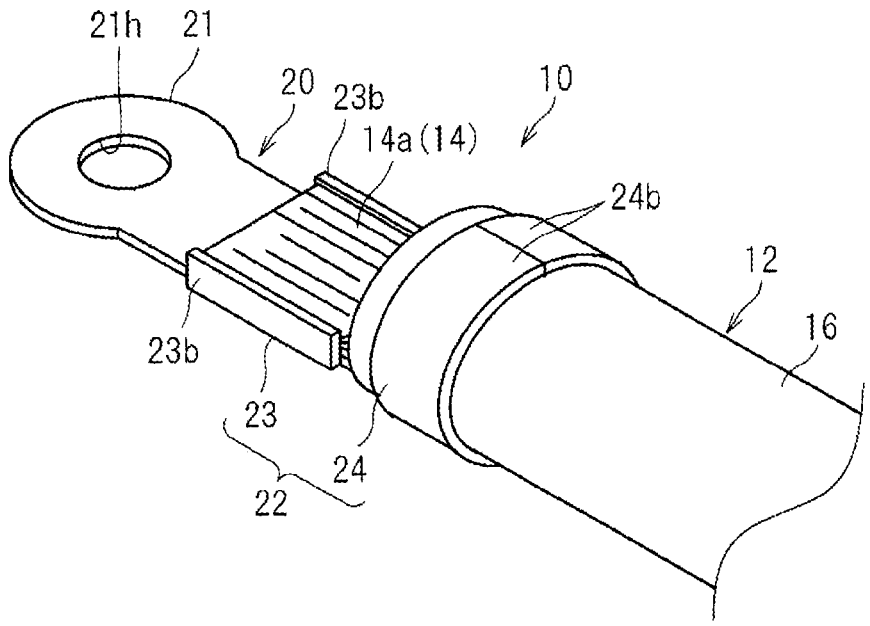
FIG. 1 is a perspective view showing a terminal-equipped electric wire.
Figure 2:
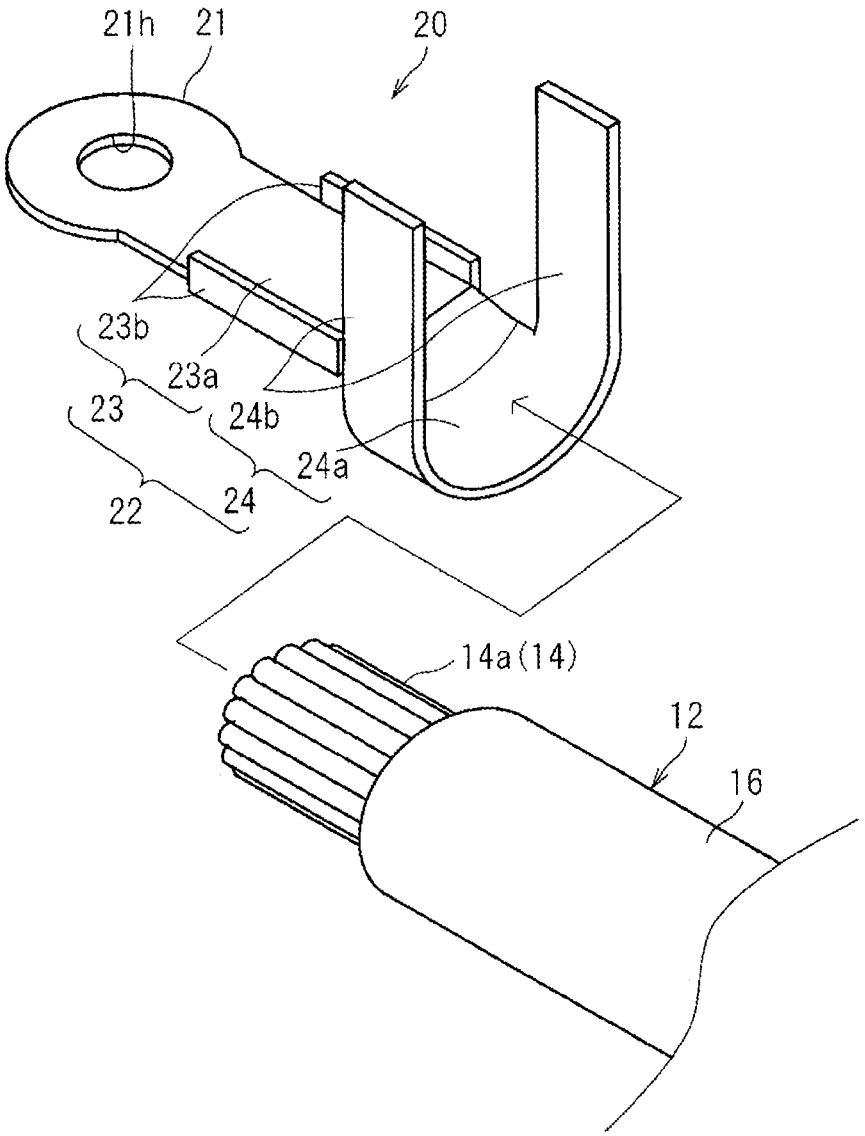
FIG. 2 is a perspective view showing an electric wire and a terminal before they are connected.
Figure 3:
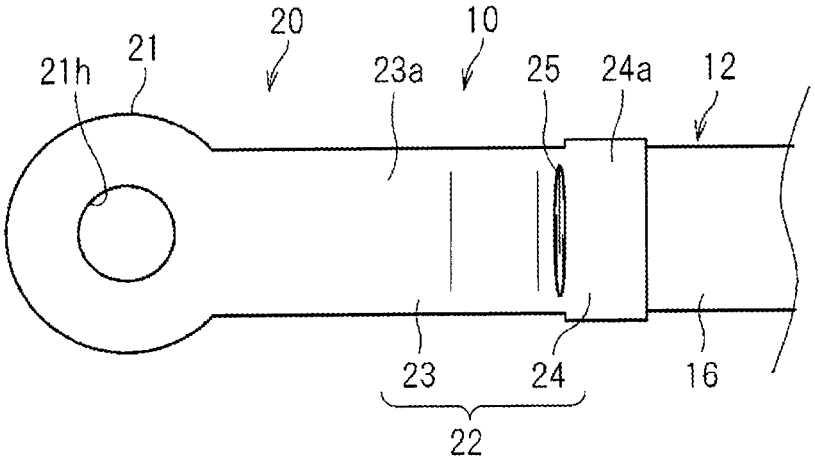
FIG. 3 is a back view showing the terminal-equipped electric wire.

First, a terminal-equipped electric wire will be illustrated. FIG. 1 is a perspective view showing a terminal-equipped electric wire 10, FIG. 2 is a perspective view showing an electric wire 12 and a terminal 20 before they are connected, and FIG. 3 is a back view of the terminal-equipped electric wire 10.

The terminal-equipped electric wire 10 is provided with the electric wire 12 and the terminal 20.

The electric wire 12 is provided with a core wire 14 and a coating 16. The core wire 14 is a linear conductive member. The core wire 14 is constituted by a group of strands (typically, twisted strands), for example. The strands (bare wires) are made of aluminum, an aluminum alloy, copper, a copper alloy, or the like. The coating 16 covers the core wire 14. The coating 16 is formed by resin that is extruded to coat the periphery of the core wire 14.

An exposed core wire 14*a* is formed by a portion of the core wire 14 being exposed from the coating 16. Here, the coating 16 is removed from the end portion of the electric wire 12, and the exposed core wire 14*a* is formed at the end portion of the electric wire 12. This exposed core wire 14*a* is ultrasonically welded to the terminal 20. If the core wire 14 is constituted by a group of strands and the strands are made of aluminum or an aluminum alloy, it is effective to ultrasonically weld the exposed core wire 14*a* to the terminal 20. This is, because it is possible to ultrasonically weld the strands to each other and the strands and the terminal to each other, and simultaneously, remove the oxide layer, which is formed on the periphery of the strands when the strands are made of aluminum or an aluminum alloy.

A braided wire formed by metal wires braided in a tubular shape may also be used as the core wire 14. A single-core wire formed by a single conductive wire may also be used as the core wire 14. A heat-shrinkable tube that covers the periphery of the core wire 14 may also be used as the coating 16.

The terminal 20 is a member formed by pressing a metal plate made of copper, a copper alloy, or the like, and includes a counterpart connection portion 21 and an electric wire connection portion 22.

The counterpart connection portion 21 is a portion to be connected to a conductive portion of a counterpart component such as a counterpart terminal or a metal body of a vehicle. Here, the counterpart connection portion 21 is configured as a plate-shaped part (here, a circular plate) having a bolt insertion hole 21*h* formed therein. That is, here, it is assumed that a round terminal for use as a ground terminal is used as the terminal 20. The counterpart connection portion 21 may also be formed in another shape such as the shape of a tab- or pin-shaped male terminal, or the shape of a circular or angular cylindrical female terminal.

The electric wire connection portion 22 is a portion to be connected to the electric wire 12. The electric wire connection portion 22 is a portion provided continuously with one end portion of the counterpart connection portion 21 described above, and includes a core wire connection portion 23 and a coating crimping portion 24. The core wire connection portion 23 is provided on the side near the counterpart connection portion 21, and the coating crimping portion 24 is provided on the side distant from the counterpart connection portion 21.

The core wire connection portion 23 includes a plate-shaped bottom portion 23*a* and a pair of side wall portions 23*b* located on opposite sides thereof. The bottom portion 23*a* is continuous with the counterpart connection portion 21, and the pair of side wall portions 23*b* are provided upright from the opposite side portions of the bottom portion 23*a* toward the first principal surface side of the bottom portion 23*a*. The core wire 14 is ultrasonically welded to the first principal surface of the bottom portion 23*a* between the pair of side wall portions 23*b*. Since the core wire 14 and the bottom portion 23*a* are pressed together and ultrasonically welded while being placed one over the other, the welding portions of the two have a structure in which the core wire 14 and the bottom portion 23*a* are placed one over the other in a flat state. Note that the core wire 14 and the bottom portion 23*a* are ultrasonically welded to each other and the plurality of strands are also ultrasonically welded to each other. Note that the pair of side wall portions 23*b* may also be omitted.

The coating crimping portion 24 includes a bottom portion 24*a* and a pair of crimping pieces 24*b*. The bottom portion 24*a* is continuous with the bottom portion 23*a* described above, and extends to the side opposite to the counterpart connection portion 21. The pair of crimping pieces 24*b* stand upright at the two end portions of the bottom portion 24*a* on the first principal surface side of the bottom portion 24*a*. With an end portion of the coating 16 disposed on the first principal surface of the bottom portion 24*a*, the pair of crimping pieces 24*b* are inwardly crimped and deformed. Consequently, the end portion of the coating 16 is crimped and fixed between the bottom portion 24*a* and the pair of crimping pieces 24*b*.

A contact mark 25 that is partially recessed (see. FIG. 3) is formed in a surface of the above-described coating crimping portion 24 that faces outward in the direction in which the exposed core wire 14*a* and the core wire connection portion 23 are welded to each other (thickness direction of the bottom portion 23*a*).

The contact mark 25 is formed by a portion that supports the coating crimping portion 24 being in contact with the coating crimping portion 24 when the coating crimping portion 24 and the exposed core wire 14*a* are ultrasonically welded to each other. When ultrasonic welding is performed, it is preferable that the coating crimping portion 24 is supported in the direction in which the coating crimping portion 24 is subjected to the applied force. For this reason, the contact mark 25 is formed on one side of the coating crimping portion 24 in the direction in which the exposed core wire 14*a* and the core wire connection portion 23 are welded to each other. In particular, since the exposed core wire 14*a* is pressed against the core wire connection portion 23 and subjected to ultrasonic welding, the contact mark 25 is subjected to the force, and thus the contact mark 25 is formed on the outward surface of the bottom portion 24*a*. Also, since ultrasonic welding is performed in a state where the coating crimping portion 24 is partially subjected to a force due to the ultrasonic welding, the above-described contact mark 25 is formed in a recess. The contact mark 25 may also be a recess like a scratch.

The contact mark 25 is preferably formed at a position of the coating crimping portion 24 that is spaced apart from the core wire connection portion 23 in a direction toward the rear end of the coating crimping portion 24 (opposite to the counterpart connection portion 21). In this manner, the coating crimping portion 24 is suppressed from being inclined toward the core wire connection portion 23 by being subjected to a force due to ultrasonic welding at a position spaced apart from the coating crimping portion 24.

The contact mark 25 will be described in more detail in the description of the manufacturing method that will be described later.

Note that it is not necessarily required to form the contact mark 25 at the above-described position. Furthermore, it is also possible that the position of the contact mark 25 changes depending on the position at which the coating crimping portion 24 is supported during ultrasonic welding. Furthermore, it is also possible that the contact mark 25 is not formed depending on the configuration by which the coating crimping portion 24 is supported.

Ultrasonic Welding Device

An ultrasonic welding device for manufacturing the terminal-equipped electric wire 10 will be described hereinafter.

Figure 4:
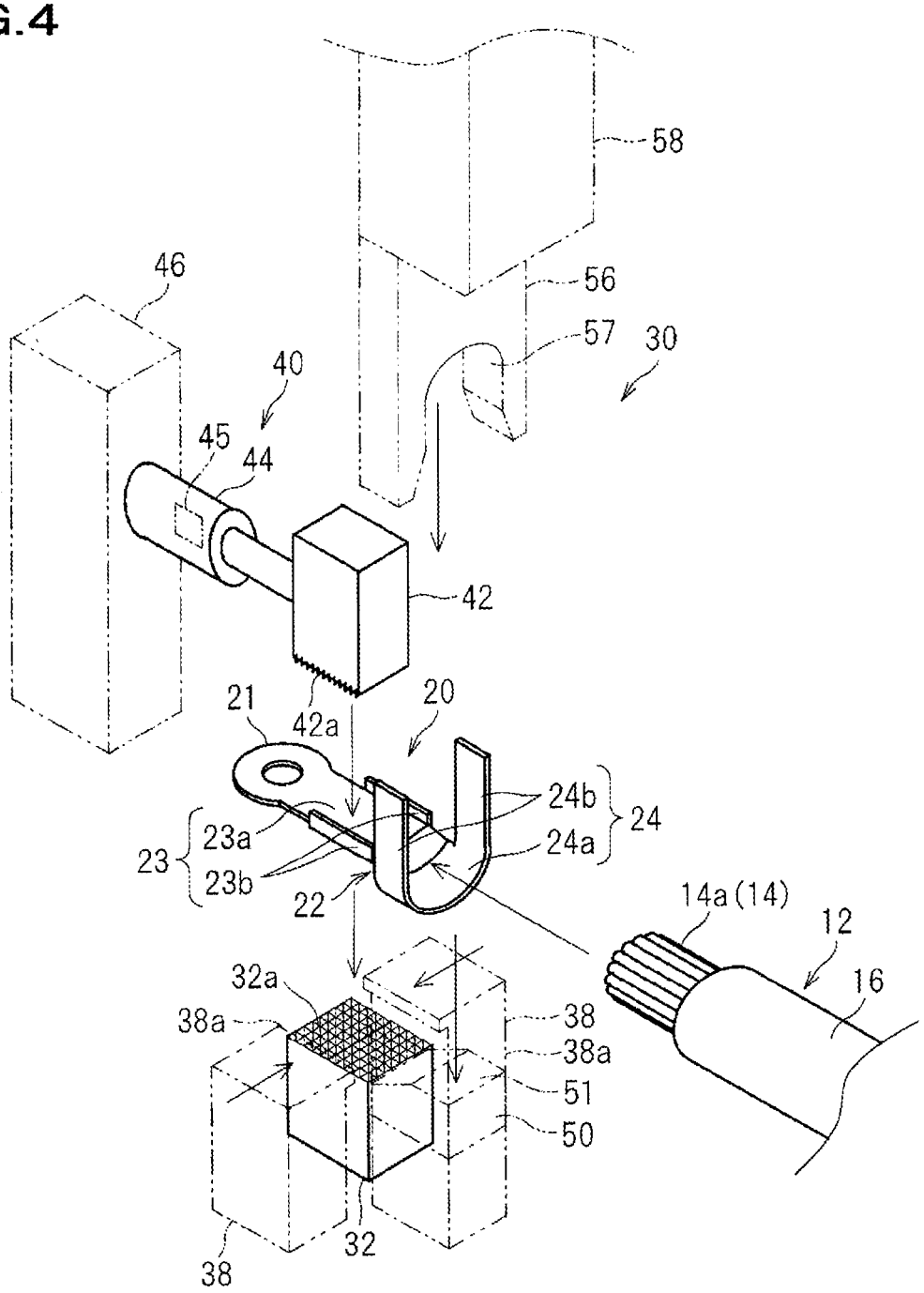
FIG. 4 is a schematic perspective view showing an ultrasonic welding device.

FIG. 4 is a schematic perspective view showing an ultrasonic welding device 30. The ultrasonic welding device 30 is a device that ultrasonically welds the exposed core wire 14*a* of the electric wire 12 to the core wire connection portion 23 of the terminal 20 as described above.

The ultrasonic welding device 30 is provided with an anvil 32, an ultrasonic vibration imparting mechanism 40, and a vibration suppressing contact portion 50.

The anvil 32 is configured to be capable of supporting the core wire connection portion 23. More specifically, the anvil 32 is supported on a base in an upwardly protruding orientation, and is configured to be capable of supporting the bottom portion 23*a* of the core wire connection portion 23 that is placed thereon. Fine recesses and protrusions are formed on an upper mounting surface 32*a* of the anvil 32. In this manner, slipping against the core wire connection portion 23 can be suppressed. Here, protrusions formed in quadrangular pyramids are tightly arranged on the mounting surface 32*a*. The mounting surface 32*a* may also be a smooth surface.

A pair of auxiliary supporting portions 38 that hold and support the terminal 20 from two sides are provided at the two side portions of the anvil 32. Pressing protrusions 38*a* protrude inward from upper portions of the pair of auxiliary supporting portions 38 toward the space between the auxiliary supporting portions 38. The pair of auxiliary supporting portions 38 can be caused to approach and separate from the anvil 32 with a driving unit formed by an air cylinder or the like. The pair of auxiliary supporting portions 38 can also be moved up and down with a driving unit formed by an air cylinder or the like. In a state where the core wire connection portion 23 is placed on the anvil 32, by the pair of auxiliary supporting portions 38 approaching, the pressing protrusions 38*a* are positioned on a pair of side wall portions 23*b* of the core wire connection portion 23. In this state, as the pair of auxiliary supporting portions 38 are lowered, the pressing protrusions 38*a* of the pair of auxiliary supporting portions 38 press the core wire connection portion 23 against the anvil 32 via the pair of side wall portions 23*b*. The auxiliary supporting portions 38 may also be omitted.

The ultrasonic vibration imparting mechanism 40 is configured to be capable of applying a force for pressing the exposed core wire 14*a* against the core wire connection portion 23 in a state where the exposed core wire 14*a* is placed on the core wire connection portion 23, and imparting ultrasonic vibration to the exposed core wire 14*a* and the core wire connection portion 23, thus ultrasonically welding the exposed core wire 14*a* and the core wire connection portion 23 together.

More specifically, the ultrasonic vibration imparting mechanism 40 is provided with a horn 42, an ultrasonic vibration generating unit 44, and an elevating driving unit 46.

The horn 42 is a member that holds and presses the core wire connection portion 23 and the exposed core wire 14*a* against each other between the horn 42 itself and the anvil 32. This horn 42 is arranged above the anvil 32 and opposes the anvil 32 such that the horn 42 can approach and separate from the anvil 32. A pressing surface 42*a* that presses against the exposed core wire 14*a* that is placed on the core wire connection portion 23 is formed at the bottom of the horn 42. The pressing surface 42*a* may be smooth, or have fine protrusions and recesses thereon, similar to the above-described mounting surface 32*a*. In FIG. 4 and so on, the horn 42 is shown in a simplified shape.

The ultrasonic vibration generating unit 44 has a long shape and one end portion thereof is connected to a portion of the outer periphery of the horn 42. In other words, the ultrasonic vibration generating unit 44 is connected to the horn 42 so as to outwardly protrude from a portion of the outer periphery of the horn 42. Another end portion of the ultrasonic vibration generating unit 44 is connected in a horizontal orientation to the elevating driving unit 46 constituted by a linear actuator such as a fluid cylinder (oil hydraulic cylinder, air cylinder), a linear motor, or the like. Then, by driving the elevating driving unit 46, the ultrasonic vibration generating unit 44 and the horn 42 at the tip end portion thereof are lowered toward the anvil 32, or elevated in the direction away from the anvil 32.

When the horn 42 is lowered by driving of the elevating driving unit 46 in a state where the core wire connection portion 23 and the exposed core wire 14*a* are placed one over the other on the anvil 32, the bottom portion 23*a* of the core wire connection portion 23 and the exposed core wire 14*a* are held between the anvil 32 and the horn 42 while being placed one over the other. In this manner, the bottom portion 23*a* and the exposed core wire 14*a* are pressed together.

The ultrasonic vibration generating unit 44 is provided with an ultrasonic vibrator 45 that generates ultrasonic vibration. The ultrasonic vibration generated by the ultrasonic vibrator 45 is transferred to the horn 42 and imparted to the exposed core wire 14*a* and the core wire connection portion 23 via the horn 42. Generally, ultrasonic vibration is imparted to the exposed core wire 14*a* and the core wire connection portion 23 as vibration along the direction in which the exposed core wire 14*a* extends.

Ultrasonic vibration is imparted to the bottom portion 23*a* and the exposed core wire 14*a* in a state where the two are pressed together between the anvil 32 and the horn 42. In this manner, the bottom portion 23*a* and the exposed core wire 14*a* are ultrasonically welded to each other.

The vibration suppressing contact portion 50 is provided so as to be capable of coming in contact with the coating crimping portion 24 during ultrasonic welding performed by the ultrasonic vibration imparting mechanism 40.

In the present embodiment, the vibration suppressing contact portion 50 is a crimping anvil. In other words, this ultrasonic welding device 30 is provided with a crimper 56. The crimper 56 is configured to crimp the coating crimping portion 24 on the coating 16 using the vibration suppressing contact portion 50 as the crimping anvil.

More specifically, the vibration suppressing contact portion 50 is provided upright with respect to the base at a position adjacent to the anvil 32. A mounting surface 51 that can support the bottom portion 24*a* of the coating crimping portion 24 that is placed thereon is formed on the upper surface of the vibration suppressing contact portion 50. Additionally, the vibration suppressing contact portion 50 is configured so as to be capable of supporting the coating crimping portion 24 that is placed thereon from the same side as the anvil 32 (from below).

Also, the vibration suppressing contact portion 50 is provided so as to come in contact with the coating crimping portion 24 at a position spaced apart from the anvil 32 toward the rear end of the coating crimping portion 24. Here, a portion of the upper portion of the vibration suppressing contact portion 50 on the side near the anvil 32 is downwardly recessed with respect to the other portions. More specifically, a portion of the upper portion of the vibration suppressing contact portion 50 on the side near the anvil 32 is downwardly inclined toward the anvil 32. A portion of the vibration suppressing contact portion 50 that is away from the anvil 32 is provided with a horizontal surface that is perpendicular to the gravitational direction, and this portion is the mounting surface 51 that supports the bottom portion 24*a* of the coating crimping portion 24 that is placed thereon. When the bottom portion 23*a* of the core wire connection portion 23 of the terminal 20 is placed and supported on the anvil 32, the lower surface on the rear side of the bottom portion 24*a* of the coating crimping portion 24 that is away from the core wire connection portion 23 comes in contact with the mounting surface 32*a* of the vibration suppressing contact portion 50 and is placed and supported thereon. The vibration suppressing contact portion 50 as described above can be easily manufactured by, for example, chipping a portion, on the anvil 32 side, of a member having a flat upper surface.

The crimper 56 is provided above the vibration suppressing contact portion 50. A crimping surface 57 that is upwardly recessed is formed at the lower portion of the crimper 56. The crimper 56 is supported above the vibration suppressing contact portion 50 and is capable of elevating with the crimping elevating driving unit 58 that is constituted by a linear actuator such as a fluid cylinder (oil hydraulic cylinder, air cylinder) and a linear motor. Then, in a state where the coating crimping portion 24 is supported on the vibration suppressing contact portion 50 and an end portion of the coating 16 is arranged in the coating crimping portion 24, when the crimper 56 is lowered by the crimping elevating driving unit 58, the pair of crimping pieces 24*b* of the coating crimping portion 24 come into contact with the crimping surface 57 and are crimped and deformed inwardly. In this manner, the pair of crimping pieces 24*b* are crimped on the coating 16. Accordingly, in a state where the coating crimping portion 24 is supported by the vibration suppressing contact portion 50, the crimper 56 crimps the coating crimping portion 24 on the coating using the vibration suppressing contact portion 50 as the crimping anvil.

Note that the above-described crimper 56 may also be omitted. In this case, the vibration suppressing contact portion 50 is not used as the crimping anvil, and it is sufficient that the vibration suppressing contact portion 50 is used as a member that comes in contact with the coating crimping portion 24 to suppress the vibration thereof when ultrasonic vibration is applied. At this time, embodiments in which the vibration suppressing contact portion comes in contact with the coating crimping portion are not limited to the above-described example. For example, the vibration suppressing contact portion may also suppress the vibration of the coating crimping portion by coming in contact with the upper, lower, right, left, or rear portions of the coating crimping portion, or coming into contact and sandwiching the coating crimping portion in a vertical or horizontal direction.

Method for Manufacturing Terminal-equipped Electric Wire

Hereinafter, a method for manufacturing the terminal-equipped electric wire 10 will be described with reference to FIG. 5 and after. Note that the parts in FIG. 5 and after may be exaggerated for illustrative reasons.

Figure 5:
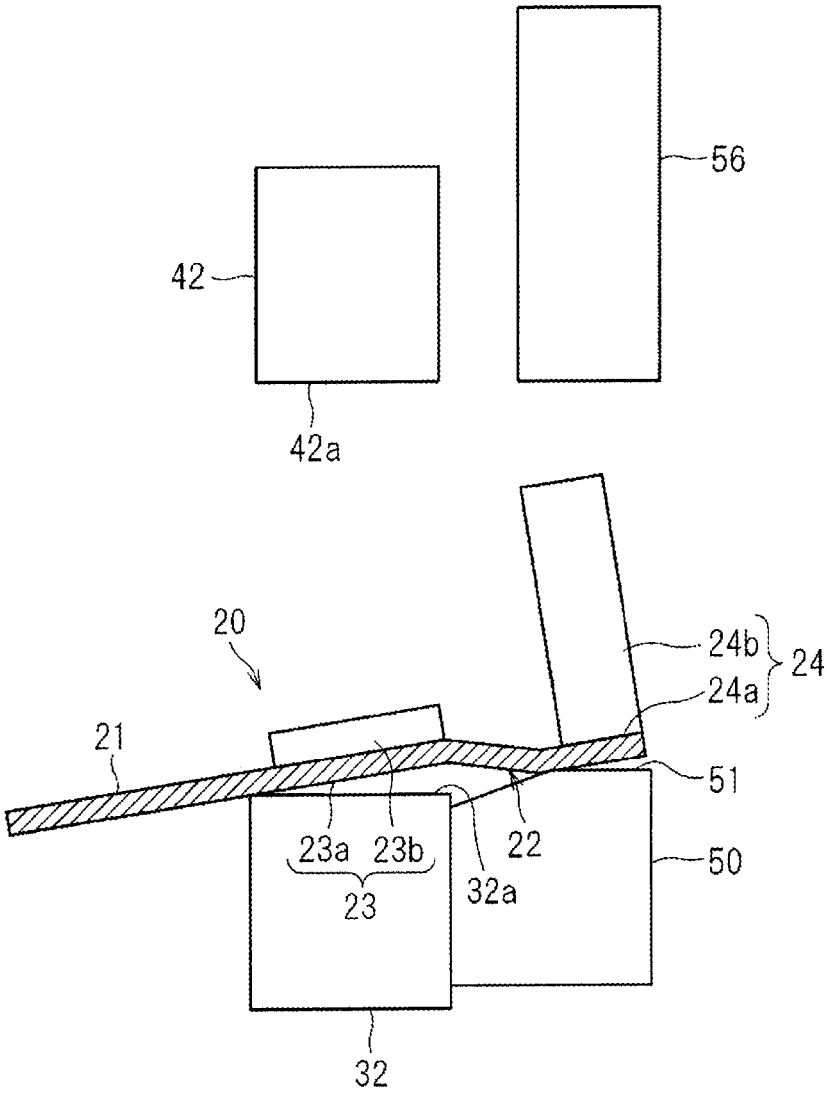
FIG. 5 is a diagram illustrating a step for manufacturing the terminal-equipped electric wire.

First, as shown in FIG. 5, the core wire connection portion 23 of the terminal 20 is supported on the anvil 32 (step (a)).

Also, the coating crimping portion 24 is brought into contact with the vibration suppressing contact portion 50 (step (b)).

In this state, it is preferable that the vibration suppressing contact portion 50 is in contact with the coating crimping portion 24 such that the bottom portion 23*a* of the core wire connection portion 23 is downwardly inclined toward the counterpart connection portion 21. In other words, in a state where the bottom portion 23*a* is placed and supported on the mounting surface 32*a* of the anvil 32 in the horizontal orientation, the mounting surface 51 of the vibration suppressing contact portion 50 is located at a position higher than the lowermost position of the core wire connection portion 23. In this manner, when the auxiliary supporting portions 38 hold the terminal 20 from the two sides in the horizontal orientation and the exposed core wire 14*a* and the bottom portion 23*a* are downwardly pressed by the horn 42, the coating crimping portion 24 is strongly pressed against the vibration suppressing contact portion 50.

Figure 6:
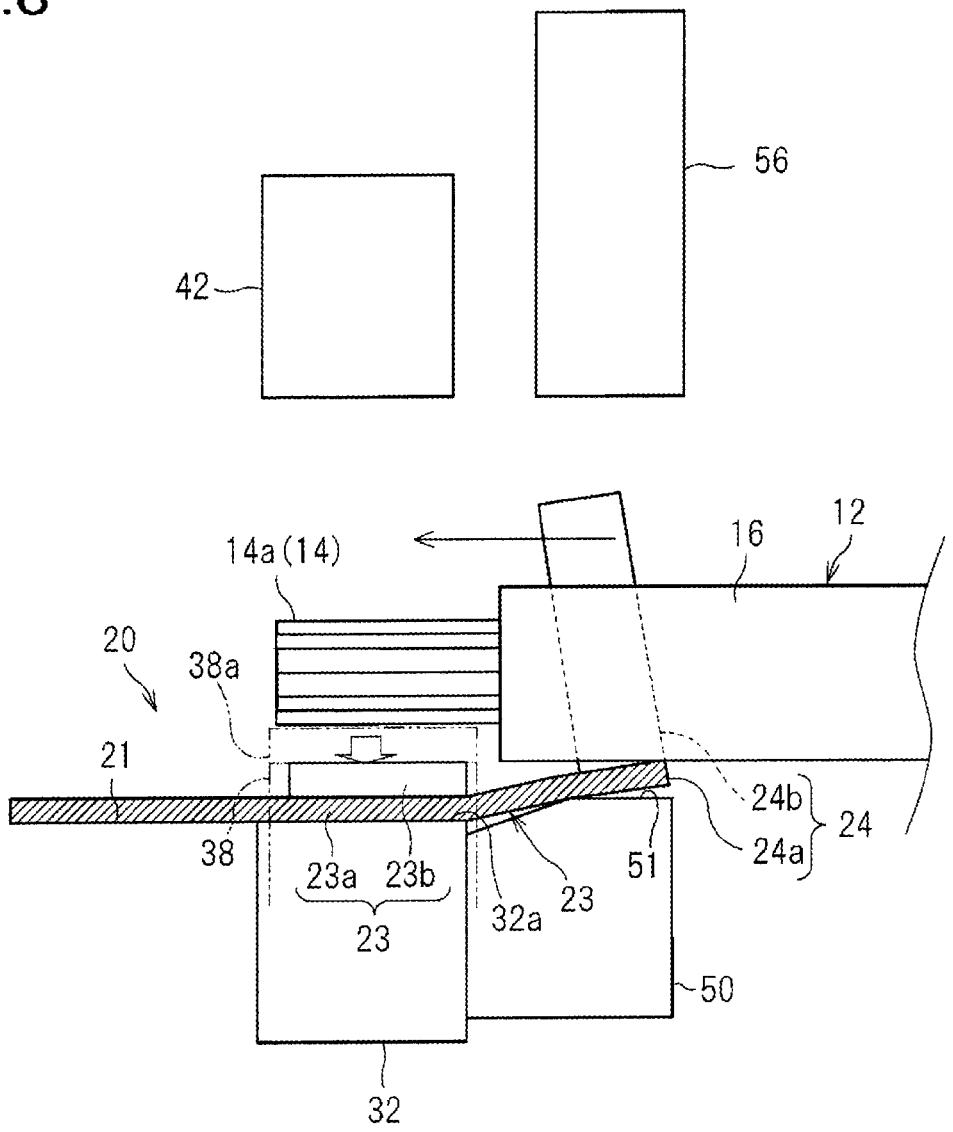
FIG. 6 is a diagram illustrating another step for manufacturing the terminal-equipped electric wire.

Then, as shown in FIG. 6, the auxiliary supporting portions 38 hold the terminal 20 from both sides, putting the terminal 20 in the horizontal orientation. Additionally, the exposed core wire 14*a* is arranged on the core wire connection portion 23 and the coating 16 of the electric wire 12 is arranged in the coating crimping portion 24 (step (c)). In this state, the exposed core wire 14*a* need not be in contact with the core wire connection portion 23. It is sufficient that the exposed core wire 14*a* is pressed against the bottom portion 23*a* while the horn 42 presses down the exposed core wire 14*a*.

Note that, when the terminal 20 is set in the ultrasonic welding device 30, step (a) and step (b) are performed simultaneously. Step (b) may also be performed after step (a) or step (c). In a case where, for example, the vibration suppressing contact portion 50 is supported so as to be capable of being driven and elevated or the like, the vibration suppressing contact portion 50 can be elevated and brought into contact with the coating crimping portion 24 after performing step (a) or step (c).

Figure 7:
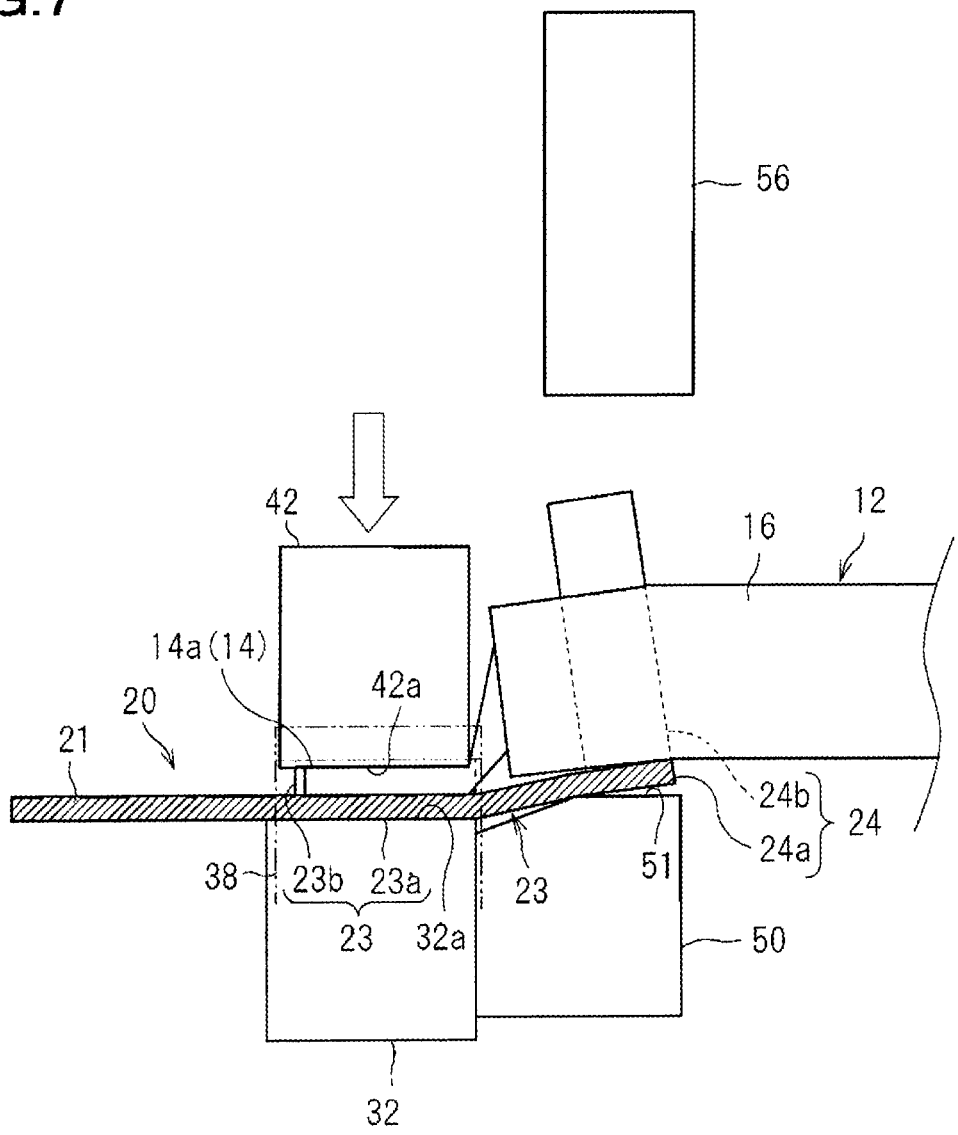
FIG. 7 is a diagram illustrating another step for manufacturing the terminal-equipped electric wire.

Thereafter, as shown in FIG. 7, in a state where the core wire connection portion 23 is supported on the anvil 32 and the coating crimping portion 24 is in contact with the vibration suppressing contact portion 50, the exposed core wire 14*a* is ultrasonically welded to the core wire connection portion 23 (step (d)). More specifically, the horn 42 is moved toward the anvil 32, and in a state where the bottom portion 23*a* and the exposed core wire 14*a* are sandwiched between the anvil 32 and the horn 42, the bottom portion 23*a* and the exposed core wire 14*a* are ultrasonically welded to each other by being subjected to ultrasonic vibration. It should be noted that at this time the plurality of strands included in the exposed core wire 14*a* are also ultrasonically welded to each other.

At this time, since the vibration suppressing contact portion 50 is in contact with the coating crimping portion 24 due to the force of the auxiliary supporting portions 38 that press the terminal and the force of the horn 42 that presses the exposed core wire 14*a* and the core wire connection portion 23, even if the ultrasonic vibration is transferred to the coating crimping portion 24, vibration of the coating crimping portion 24 itself is suppressed. Accordingly, cracks are not likely to occur at the base end of the coating crimping portion 24.

In particular, the vibration suppressing contact portion 50 supports the coating crimping portion 24 from the same side as the anvil 32. For this reason, by at least one of the two forces, namely, the force of the auxiliary supporting portions 38 that press the terminal 20 from the two sides, and the force of the horn 42 that presses the bottom portion 23*a* against the anvil 32, the bottom portion 24*a* that is continuous with the bottom portion 23*a* is pressed against the vibration suppressing contact portion 50. For this reason, a pressing force that holds the terminal 20 for performing ultrasonic welding or a pressing force that presses the exposed core wire 14*a* against the terminal 20 can be used as a force for strongly pressing the coating crimping portion 24 against the vibration suppressing contact portion 50. Also, since the bottom portion 24*a* is pressed against the vibration suppressing contact portion 50, vibration of the vibration suppressing contact portion 50 can be suppressed more effectively, and cracks at the base end of the coating crimping portion 24 can be suppressed more effectively.

Figure 8:
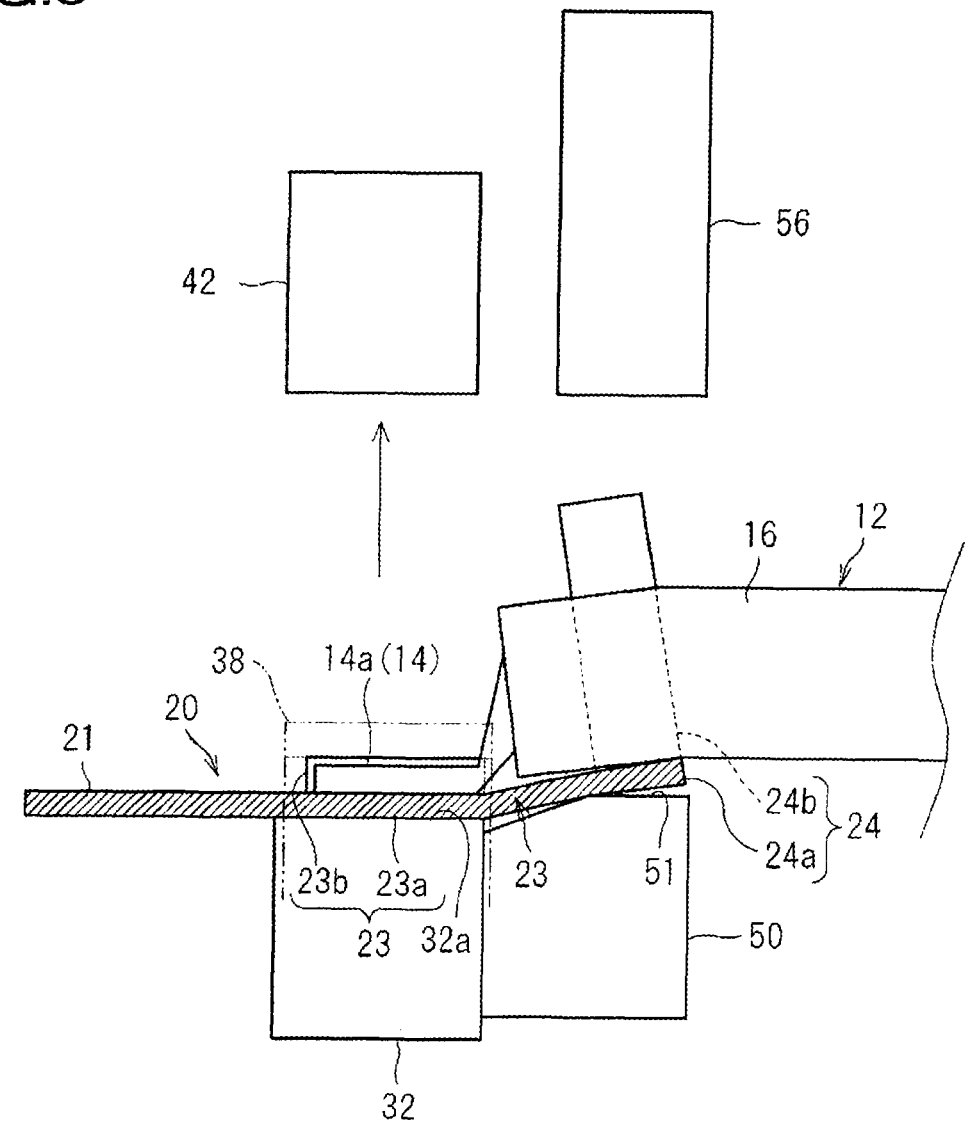
FIG. 8 is a diagram illustrating another step for manufacturing the terminal-equipped electric wire.

Thereafter, as shown in FIG. 8, the horn 42 is upwardly moved. Then, the exposed core wire 14*a* that has been ultrasonically welded to the core wire connection portion 23 of the terminal 20 is left on the anvil 32 and the vibration suppressing contact portion 50.

Figure 9:
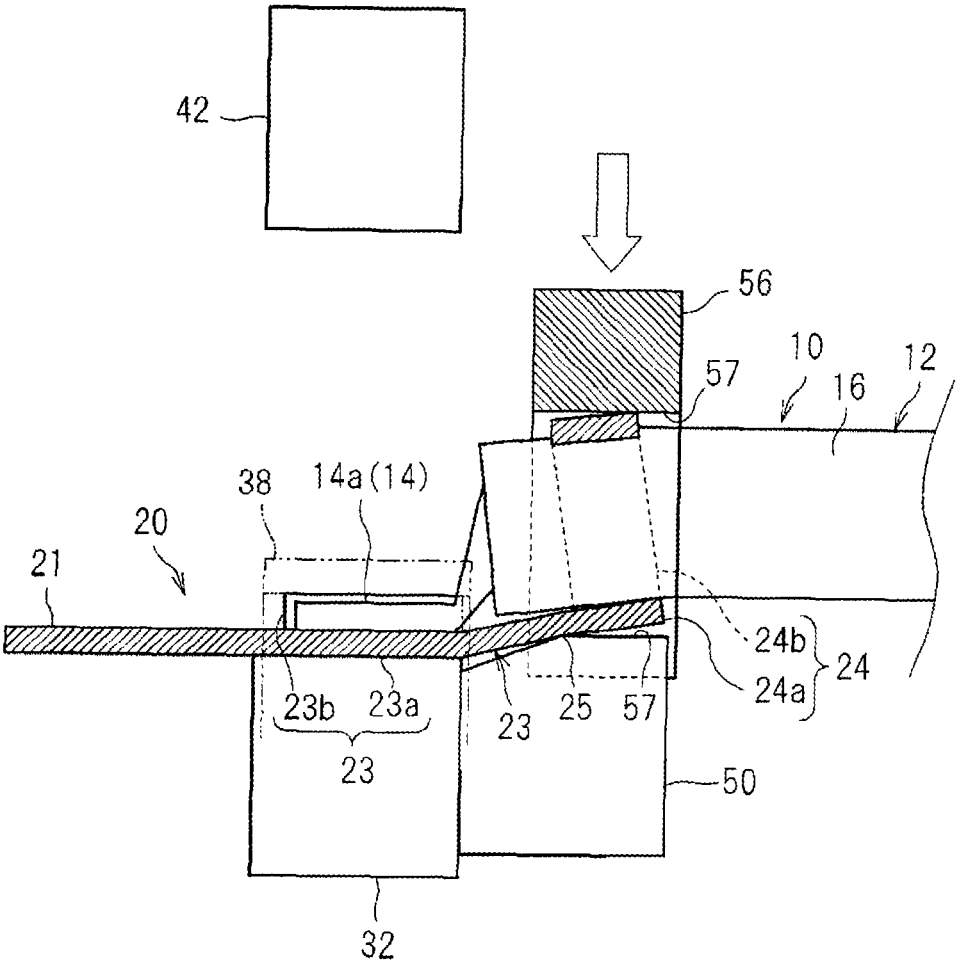
FIG. 9 is a diagram illustrating another step for manufacturing the terminal-equipped electric wire.

Thereafter, as shown in FIG. 9, in a state where the coating crimping portion 24 is supported on the vibration suppressing contact portion 50, the crimper 56 is lowered to crimp the coating crimping portion 24 on the coating 16 using the vibration suppressing contact portion 50 as the crimping anvil (step (e)). Here, crimping is performed in a state where the terminal 20 is crimped by the auxiliary supporting portions 38. This crimping step may also be performed with the above-described ultrasonically welding step simultaneously.

Thereafter, when the crimper 56 is elevated, a terminal-equipped electric wire 10 is manufactured, in which the exposed core wire 14*a* has been ultrasonically welded to the core wire connection portion 23 of the terminal 20 and the coating crimping portion 24 has been crimped to the coating 16.

Note that embodiments are also preferable in which, in step (d), the coating crimping portion 24 is supported on the vibration suppressing contact portion 50 in a state where the coating crimping portion 24 is in contact with the vibration suppressing contact portion 50 at a position spaced apart from the anvil 32 in the direction toward the rear end of the coating crimping portion 24 (see FIG. 7). In this case, even if the bottom portion 24*a* is strongly pressed against the vibration suppressing contact portion 50, the bottom portion 24*a* is not likely to be greatly inclined toward the bottom portion 23*a*.

Figure 10:
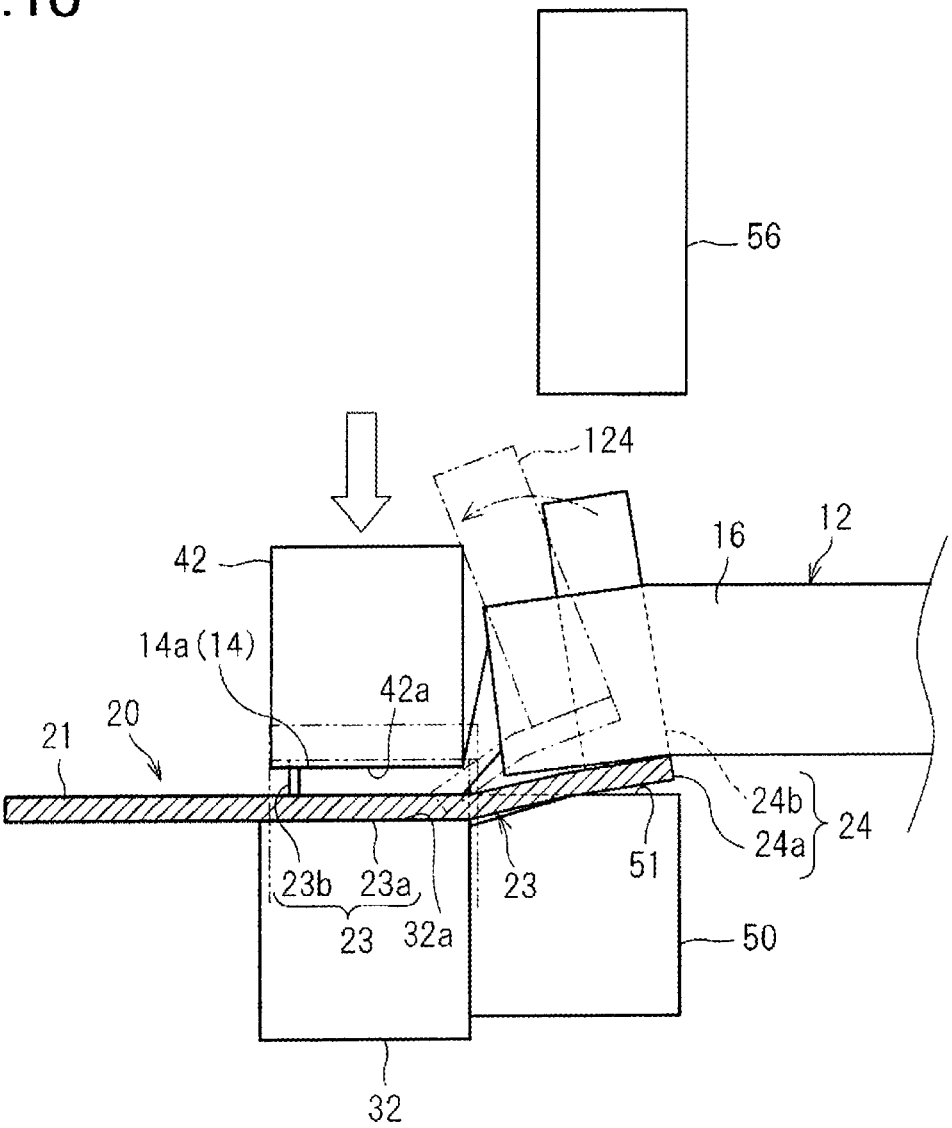
FIG. 10 is a diagram illustrating another step for manufacturing the terminal-equipped electric wire.

To illustrate more specifically, let us assume a case where the coating crimping portion 24 supports the coating crimping portion 24 at a position adjacent to the anvil 32, as in the coating crimping portion 124 shown by a two-dot chain line in FIG. 10. In this case, if the auxiliary supporting portions 38 and the horn 42 press the bottom portion 23*a* against the anvil 32, a portion of the bottom portion 24*a* that is near the bottom portion 23*a* is greatly lifted up. Accordingly, the bottom portion 24*a* is greatly inclined with respect to the bottom portion 23*a*. Then, the pair of crimping pieces 24*b* are inclined toward the core wire connection portion 23. In this state, if the pair of the crimping pieces 24*b* are crimped on the coating 16 and deformed, the pair of crimping pieces 24*b* will be crimped on the coating 16 that protrudes from the end portion of the coating 16 toward the exposed core wire 14*a*. Since the coating crimping portion 24 is generally provided in order to ensure the strength against the terminal 20, it is preferable that the coating crimping portion 24 is crimped on the coating 16 without protruding from the coating 16. If the pair of crimping pieces 24*b* protrude from the coating 16, there will be a possibility that the desired strength cannot be achieved.

Figure 11:
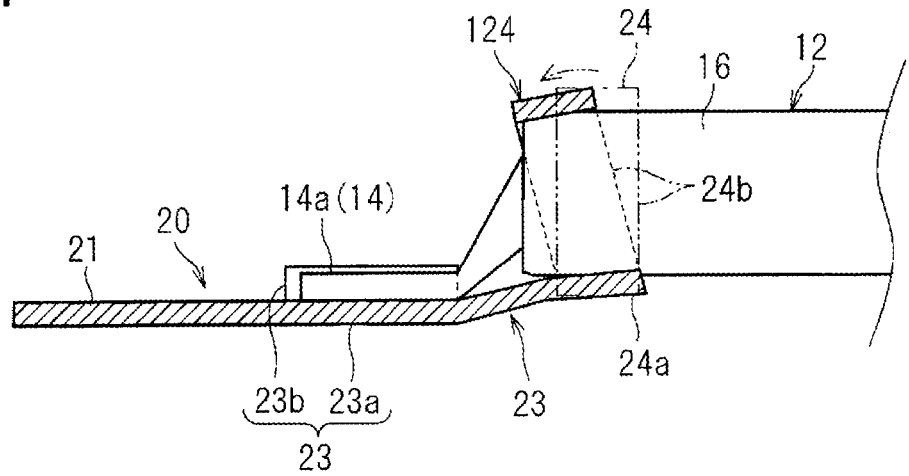
FIG. 11 is a diagram illustrating how the terminal is crimped to an electric wire.

In view of this, in step (d), the coating crimping portion 24 is supported on the vibration suppressing contact portion 50 in a state where the coating crimping portion 24 is in contact with the vibration suppressing contact portion 50 at a position spaced apart from the anvil 32 toward the rear end of the coating crimping portion 24 (see FIG. 7). By doing this, even if the bottom portion 24*a* is strongly pressed against the vibration suppressing contact portion 50, the bottom portion 24*a* is not likely to be greatly inclined with respect to the bottom portion 23*a*. For this reason, if the pair of crimping pieces 24*b* are crimped on the coating 16 and deformed, the pair of crimping pieces 24*b* are not likely to protrude from the end portion of the coating 16 toward the exposed core wire 14*a*, and thus it is possible to reliably crimp the coating crimping portion 24 on the coating 16 (see FIG. 9, or the two-dot chain lines in FIG. 11).

In the terminal-equipped electric wire 10 manufactured as above, it is conceivable that a contact mark 25 that is partially recessed is formed on the surface of the coating crimping portion 24 that faces outward (downward) in the direction in which the exposed core wire 14*a* and the core wire connection portion 23 (see FIG. 3) are welded to each other. In particular, if the coating crimping portion 24 is ultrasonically welded in a state where the coating crimping portion 24 is in contact with the vibration suppressing contact portion 50 at a position spaced apart from the anvil 32 in the direction toward the rear end of the coating crimping portion 24, the contact mark 25 is formed at a position spaced apart from the core wire connection portion 23 toward the coating crimping portion 24. Here, the contact mark 25 is formed along the boundary line between the mounting surface 51 and the inclined portion in front thereof. It is also conceivable that a contact mark shaped like a scratched mark will be formed in a large region depending on the shape of the mounting surface.

Effects

According to the method for manufacturing the terminal-equipped electric wire, the terminal-equipped electric wire 10, and the ultrasonic welding device 30 configured as described above, since the exposed core wire 14*a* is ultrasonically welded to the core wire connection portion 23 in a state where the core wire connection portion 23 is supported on the anvil 32 and the coating crimping portion 24 is in contact with the vibration suppressing contact portion 50, even if the vibration due to ultrasonic welding is transferred to the coating crimping portion 24, vibration of the coating crimping portion 24 is suppressed. For this reason, it is possible to suppress cracks at the base end of the coating crimping portion 24 of the terminal 20 and ultrasonically weld the core wire connection portion 23 of the terminal 20 to the exposed core wire 14*a* of the electric wire 12.

Additionally, since the vibration suppressing contact portion 50 is in contact with the coating crimping portion 24 on the same side as the anvil 32, the coating crimping portion 24 is pressed against the vibration suppressing contact portion 50 by a holding force or a pressing force during ultrasonic welding. For this reason, the vibration of the coating crimping portion 24 can be effectively suppressed and cracks at the base end of the coating crimping portion 24 can be more reliably suppressed.

Also, when attempting to strongly press the coating crimping portion 24 against the vibration suppressing contact portion 50 during ultrasonic welding, the coating crimping portion 24 is likely to be greatly inclined toward the core wire connection portion 23. When the coating crimping portion 24 that has been greatly deformed and inclined toward the core wire connection portion 23 is crimped on the coating 16, there is a risk that the pair of crimping pieces 24*b* will protrude from the coating 16. In view of this, the coating crimping portion 24 is supported on the vibration suppressing contact portion 50 in a state where the coating crimping portion 24 is in contact with the vibration suppressing contact portion 50 at a position spaced apart from the anvil 32 toward the base end of the coating crimping portion 24. In this manner, even if the coating crimping portion 24 is strongly pressed against the vibration suppressing contact portion 50 during ultrasonic welding, the coating crimping portion 24 is not likely to be inclined toward the core wire connection portion 23. In this manner, the coating crimping portion 24 is not likely to protrude from the coating 16 when the coating crimping portion 24 is crimped on the coating 16.

However, in a case where the vibration suppressing contact portion 50 is in contact with the coating crimping portion 24 at a position at which the coating crimping portion 24 is not greatly inclined with respect to the bottom portion 23*a*, the vibration suppressing contact portion 50 may also be in contact with the coating crimping portion 24 at a position adjacent to the anvil.

Also, since the coating crimping portion 24 is crimped on the exposed core wire 14*a* using the above-described vibration suppressing contact portion 50 as the crimping anvil, ultrasonic welding and crimping can be performed with a simple configuration.

It is not essentially required that ultrasonic welding and crimping are performed by a same device, and ultrasonic welding and crimping may also be performed by individual devices.

Variation

Although the present embodiment describes an example in which the terminal 20 is crimped on the exposed core wire 14*a* that is exposed at the end portion of the electric wire 12, the present invention may also be applied to a case in which the terminal for splice connection is ultrasonically welded to the core wire that is exposed in the middle of the electric wire in the direction in which the electric wire extends, and the crimping portion provided at at least one end of the terminal is crimped on the coating.

Note that the configurations illustrated in the embodiment and the variation may be combined as appropriate as long as no mutual contradiction arises.

Although the present invention was described in detail as described above, the above-described illustration is exemplary in all aspects, and the present invention is not limited thereto. It should be comprehended that countless variations that are not illustrated herein can be conceived without departing from the scope of the present invention.

LIST OF REFERENCE NUMERALS

10 Terminal-equipped electric wire
12 Electric wire
14 Core wire
14*a* Exposed core wire
16 Coating
20 Terminal
22 Electric wire connection portion
23 Core wire connection portion
23*a* Bottom portion
24 Coating crimping portion
24*a* Bottom portion
24*b* Crimping piece
25 Contact mark
30 Ultrasonic welding device
32 Anvil
40 Ultrasonic vibration imparting mechanism
42 Horn
44 Ultrasonic vibration generating unit
45 Ultrasonic vibrator
46 Elevating driving unit
50 Vibration suppressing contact portion
56 Crimper
58 Crimping elevating driving unit

The invention claimed is:

1. A method for manufacturing a terminal-equipped electric wire by ultrasonically welding a core wire of an electric wire to a core wire connection portion of a terminal that includes the core wire connection portion and a coating crimping portion, the method comprising:

supporting the core wire connection portion on an anvil;

bringing the coating crimping portion into contact with a vibration suppressing contact portion;

providing a contact surface of the vibration suppressing contact portion, which contacts the coating crimping portion, at a higher elevation than a contact surface of the anvil on which the core wire connection portion is supported;

arranging the core wire on the core wire connection portion and arranging a coating of the electric wire in the coating crimping portion; and ultrasonically welding the core wire to the core wire connection portion in a state where the core wire connection portion is supported on the anvil and the coating crimping portion is in contact with the vibration suppressing contact portion, wherein the coating crimping portion is supported on the vibration suppressing contact portion in a state where the coating crimping portion is in contact with the vibration suppressing contact portion at a position spaced apart from the anvil in a direction toward a rear end of the coating crimping portion, and in the ultrasonic welding, a region in which the terminal is not in contact with the anvil and the vibration suppressing contact portion is present between the portion in which the anvil and the core wire connection portion are in contact with each other and a region in which the vibration suppressing contact portion and the coating crimping portion are in contact with each other.

2. The method for manufacturing the terminal-equipped electric wire according to claim 1, wherein the vibration suppressing contact portion supports the coating crimping portion from the same side as the anvil.

3. The method for manufacturing the terminal-equipped electric wire according to claim 2, further comprising:

crimping the coating crimping portion on the coating using the vibration suppressing contact portion as a crimping anvil in a state where the coating crimping portion is supported on the vibration suppressing contact portion.

4. A terminal-equipped electric wire comprising:

an electric wire that includes a core wire and a coating that covers a periphery of the core wire, a portion of the core wire being an exposed core wire that is exposed from the coating; and a terminal that includes a core wire connection portion that is ultrasonically welded to the exposed core wire, and a coating crimping portion that is crimped on the coating, a non-through contact mark that is partially recessed being formed on an outer surface of the coating crimping portion that faces outward in a direction in which the exposed core wire and the core wire connection portion are welded to each other, wherein the outer surface is opposite a surface of the coating crimping portion that contacts the coating.

5. The terminal-equipped electric wire according to claim 4, wherein the contact mark is formed at a position of the coating crimping portion that is spaced apart from the core wire connection portion in a direction toward the rear end of the coating crimping portion.

6. An ultrasonic welding device that ultrasonically welds a core wire of an electric wire to a core wire connection portion of a terminal that includes a core wire connection portion and a coating crimping portion, the ultrasonic welding device comprising:

an anvil that supports the core wire connection portion;

an ultrasonic vibration imparting mechanism that, in a state where the core wire is placed on the core wire connection portion that is supported on the anvil, applies a force that presses the core wire against the core wire connection portion, and imparts ultrasonic vibration to the core wire and the core wire connection portion to ultrasonically weld the core wire and the core wire connection portion; and a vibration suppressing contact portion that comes in contact with the coating crimping portion during ultrasonic welding performed by the ultrasonic vibration imparting mechanism, wherein a contact surface of the vibration suppressing contact portion, which contacts the coating crimping portion, is positioned at a higher elevation than a contact surface of the anvil on which the core wire connection portion is supported, wherein the vibration suppressing contact portion comes in contact with the coating crimping portion at a position spaced apart from the anvil in a direction toward the rear end of the coating crimping portion, and a region in which the terminal is not in contact with the anvil and the vibration suppressing contact portion is present between the portion in which the anvil and the core wire connection portion are in contact with each other and a region in which the vibration suppressing contact portion and the coating crimping portion are in contact with each other.

7. The ultrasonic welding device according to claim 6, wherein the vibration suppressing contact portion supports the coating crimping portion from the same side as the anvil.

8. The ultrasonic welding device according to claim 7, further comprising:

a crimper that crimps the coating crimping portion on the coating of the electric wire using the vibration suppressing contact portion as a crimping anvil in a state where the coating crimping portion is supported by the vibration suppressing contact portion.

* * * * *